US006753050B1

(12) United States Patent
Dalvey et al.

(10) Patent No.: US 6,753,050 B1
(45) Date of Patent: Jun. 22, 2004

(54) IMAGE TRANSFER SHEET

(75) Inventors: Jodi A. Dalvey, Orono, MN (US); Nabill F. Nasser, Minneapolis, MN (US)

(73) Assignee: Jody A. Dalvey, Orono, MN (US)

( * ) Notice: Subject to any disclaimer, the term of this patent is extended or adjusted under 35 U.S.C. 154(b) by 0 days.

(21) Appl. No.: 09/661,532

(22) Filed: Sep. 14, 2000

Related U.S. Application Data

(63) Continuation-in-part of application No. 09/541,874, filed on Apr. 3, 2000, now abandoned.

(51) Int. Cl.[7] ..... B41M 5/00; B41M 5/40

(52) U.S. Cl. ..... 428/32.12; 428/32.51

(58) Field of Search ..... 428/195, 484, 428/488.4, 9.3, 9.4, 32.51, 32.12

(56) References Cited

U.S. PATENT DOCUMENTS

| | | | | |
|---|---|---|---|---|
| 3,790,439 A | | 2/1974 | La Perre et al. | 161/167 |
| 3,922,435 A | | 11/1975 | Asnes | 428/349 |
| 4,224,358 A | | 9/1980 | Hare | 427/147 |
| 4,235,657 A | | 11/1980 | Greenman et al. | 156/234 |
| 4,399,209 A | | 8/1983 | Sanders et al. | 430/138 |
| 4,548,857 A | | 10/1985 | Galante | 428/200 |
| 4,880,678 A | | 11/1989 | Goffi | 428/40 |
| 4,966,815 A | | 10/1990 | Hare | 428/497 |
| 4,980,224 A | | 12/1990 | Hare | 428/202 |
| 5,019,475 A | | 5/1991 | Higashiyama et al. | 430/138 |
| 5,059,580 A | | 10/1991 | Shibata et al. | 503/227 |
| 5,097,861 A | | 3/1992 | Hopkins et al. | 137/78.3 |
| 5,110,389 A | | 5/1992 | Hiyoshi et al. | 156/234 |
| 5,139,917 A | | 8/1992 | Hare | 430/138 |
| 5,236,801 A | | 8/1993 | Hare | 430/199 |
| 5,252,531 A | | 10/1993 | Yasuda et al. | 503/227 |
| 5,271,990 A | | 12/1993 | Kronzer et al. | 428/195 |
| 5,334,439 A | | 8/1994 | Kawaguchi et al. | 428/212 |
| 5,350,474 A | * | 9/1994 | Yamane | 156/240 |
| 5,362,703 A | | 11/1994 | Kawasaki et al. | 503/227 |
| 5,400,246 A | | 3/1995 | Wilson et al. | 364/146 |
| 5,407,724 A | | 4/1995 | Mimura et al. | 428/141 |
| 5,707,925 A | | 1/1998 | Akada et al. | 503/227 |
| 5,770,268 A | | 6/1998 | Kuo et al. | 427/386 |
| 5,798,161 A | | 8/1998 | Kita et al. | 428/64.1 |
| 5,905,497 A | | 5/1999 | Vaughan et al. | 345/352 |
| 5,917,730 A | | 6/1999 | Rittie et al. | 364/578 |
| 6,017,611 A | | 1/2000 | Cheng et al. | 428/195 |
| 6,106,982 A | * | 8/2000 | Mientus et al. | 430/14 |
| 2001/0051265 A1 | * | 12/2001 | Williams et al. | 428/343 |

FOREIGN PATENT DOCUMENTS

| | | | | |
|---|---|---|---|---|
| EP | 0466503 | | 7/1990 | G03G/7/00 |
| EP | 782931 | * | 7/1997 | B41M/5/00 |

OTHER PUBLICATIONS

Product Bulletins: Photopia, Unimark, and Chromicolor, retrieved from Matsui International website (www.matsui-color.com), site visited Feb. 15, 2002.*

* cited by examiner

*Primary Examiner*—B. Hamilton Hess
(74) *Attorney, Agent, or Firm*—Schwegmen, Lundberg, Woesner & Kluth, P.A.

(57) ABSTRACT

The present invention includes an image transfer sheet. The image transfer sheet includes an image imparting layer and an adhesive layer. The adhesive layer permits transfer of an image to a substrate.

9 Claims, 2 Drawing Sheets

IMAGE TRANSFER SHEET

This application is a Continuation-In-Part of U.S. application Ser. No. 09/541,874, filed Apr. 3, 2000 Now Abandoned.

BACKGROUND OF THE INVENTION

The present invention relates to an image transfer sheet capable of image transfer without substantial application of heat, a method for making the image transfer sheet, and a method for transferring an image to a substrate from an image transfer sheet, without a substantial addition of heat.

Image transfer to articles made from materials such as fabric, nylon, plastics and the like has increased in popularity over the past decade due to innovations in image development. On Feb. 5, 1974, La Perre issued a United States patent describing a transfer sheet material markable with uniform indicia and applicable to book covers. This sheet material included adhered plies for an ink-receptive printable layer and a solvent-free, heat-activatable adhesive layer. The adhesive layer was somewhat tacky prior to heat activation to facilitate positioning of a composite sheet material on a substrate which was to be bonded. The printable layer had a thickness of 10–500 microns and had an exposed porous surface of thermoplastic polymeric material at least 10 microns thick.

Indicia were applied to the printable layer with an old typewriter. A thin film of temperature-resistant, low surface energy polymer, such as polytetrafluoroethylene surface and heated with an iron. Heating caused the polymer in the printable layer to fuse, thereby sealing the indicia into the printable layer.

On Sep. 23, 1980, Hare had issued U.S. Pat. No. 4,224,358 described a kit for applying a colored emblem to a t-shirt. The kit comprised a transfer sheet which included the outline of a mirror image of a message. To utilize the kit, a user applied a colored crayon to the transfer sheet and positioned the transfer sheet on a T-shirt. A heated instrument was applied to the reverse side of the transfer sheet in order to transfer the colored message.

The Greenman et al. patent, U.S. Pat. No. 4,235,657, issuing Nov. 25, 1980, described a transfer web for a hot melt transfer of graphic patterns onto natural, synthetic fabrics. The transfer web included a flexible substrate coated with a first polymer film layer and a second polymer film layer. The first polymer film layer was made with a vinyl resin and a polyethylene wax which were blended together in a solvent or liquid solution. The first film layer served as a releasable, separable layer during heat transfer. The second polymeric film layer was an inonomer in an aqueous dispersion. An ink composition was applied to a top surface of the second film layer. Application of heat released the first film layer from the substrate while activating the adhesive property of the second film layer, thereby transferring the printed pattern and a major part of the first layer along with the second film layer onto a work piece. The second film layer bonded the printed pattern to the work piece while serving as a protective layer for the pattern.

The Sanders et al. patent, U.S. Pat. No. 4,399,209, issuing Aug. 16, 1983, and describes an imaging system in which images were formed by exposing a photosensitive encapsulate to actinic radiation and rupturing the capsules in the presence of a developer so that there was a pattern reaction of a chromogenic material present in the encapsulate or co-deposited on a support with the encapsulate and the developer which yielded an image.

The Goffi patent, U.S. Pat. No. 4,880,678, issuing Nov. 14, 1989, describes a dry transfer sheet that comprises a colored film adhering to a backing sheet with an interposition of a layer of release varnish. The colored film included 30–40% pigment, 1–4% of cycloaliphatic epoxy resin, from 15–35% of vinyl copolymer, from 1–4% of polyethylene wax. This particular printing process was described as being suitable for transferring an image to a panel of wood.

The Kronzer et al. patent, U.S. Pat. No. 5,271,990, issuing Dec. 21, 1993, describes an image-receptive heat transfer paper that included a flexible paper-based web sheet and an image-receptive melt transfer film that overlaid a top surface of the base sheet. The image-receptive melt transfer film was comprised of a thermoplastic polymer melting at a temperature within a range of 65–180° C.

The Higashiyami et al. patent, U.S. Pat. No. 5,019,475, issuing May 28, 1991, describes a recording medium that included a base sheet, a thermoplastic resin layer formed on at least one side of the base sheet and a color developer layer formed on a thermoplastic resin layer and capable of color development by reacting with a dye precursor.

SUMMARY OF THE INVENTION

One embodiment of the present invention includes an image transfer sheet. The image transfer sheet comprises an image imparting layer and an adhesive layer that permits transfer of an image on the image imparting layer to a substrate.

Another embodiment of the present invention includes a kit. The kit comprises an image transfer sheet and a substrate. The image transfer sheet comprises a base layer and an adhesive layer that overlays the base layer.

Another embodiment of the present invention includes a method for transferring an image to a substrate from an image transfer sheet, without an application of heat. The method comprises providing a sheet comprising a base layer and an adhesive layer that overlays the base layer. The sheet has an image. A substrate is provided for receiving the image. The base layer is separated from the adhesive layer. The sheet is contacted to the substrate so that the adhesive layer contacts the substrate, thereby transferring the image to the substrate.

DETAILED DESCRIPTION

Figure 1:
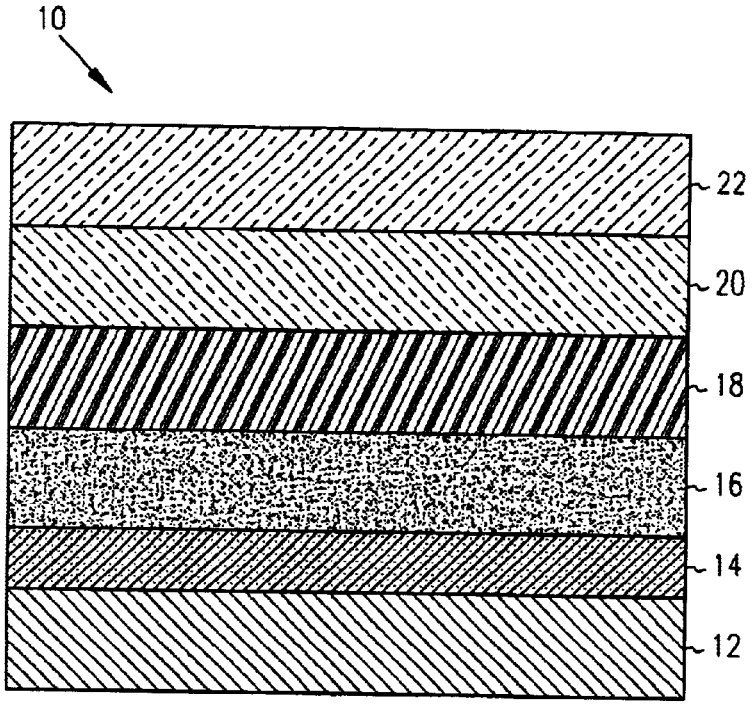
FIG. 1 illustrates a cross-sectional view of one embodiment of the image transfer sheet of the present invention.

The image transfer sheet of the present invention, one embodiment of which is illustrated generally at 10 in FIG. 1, provides for a transfer of an image from the sheet to a surface such as a T-shirt surface without an application of heat, such as heat from an iron. The image transfer sheet of the present invention 10 comprises a base layer 12, a release layer 14 that overlays the base layer, an adhesive layer 16, such as a PSA adhesive, a polymer layer 18 that overlays the adhesive layer, an optional primer layer 20 for receiving ink that overlays the polymer layer and an optional second ink-receiving layer 22 that overlays the primer or first receiving layer 20. An image or a portion of an image is imparted to one or more of the adhesive layer 16, polymer layer 18, primer layer 20 or optional second ink-receiving layer 22.

As used herein, the term "PVP" refers to poly vinyl pyrolidone.

As used herein, the term "AS" refers to acrylo styrene.

As used herein, the term "PA" refers to polyacrylanide.

As used herein, the term "EVA" refers to ethylene vinyl acetate.

As used herein, the term "EAA" refers to ethylene acrylic acid.

As used herein, the term "EMA" refers to ethylene methylacrylate copolymer.

As used herein, the term "MEAA" refers to methane acrylic ethylene acrylate

As used herein, the term "PSA" refers to pressure sensitive adhesive.

As used herein, the term "SBR" refers to styrene butadiene resin.

As used herein, the term "Nucrel®" refers to MEAA resin, manufactured by DuPont de Neimours of Wilmington, Del.

As used herein, the term "PVO" refers to polyvinyl hydroxide.

As used herein, the terms "photophopia®" and "Chlorocolor®" and "Chromocolour®" refers to a material that changes color with changes in temperature and changes in light. Photopia is an ink manufactured by Matsui Shikiso Chemical Co. of Kyoto, Japan. "Chromacolor" is a paint manufactured by Chromacolor Intl. Ltd. Of Calgary, AB, CA.

As used herein, the term "VA" refers to vinyl acetate.

Weight percentages used herein refer to a dry weight basis.

The image transfer sheet of the present invention accomplishes by the use of an adhesive, such as a PSA adhesive, or hot melt or water-activated adhesive, or a UV cured adhesive, or an electro-beam cured adhesive or an epoxy-based adhesive, what a conventional image transfer layer accomplishes with heat; that is, transfer of an image from the image transfer sheet 10 to a substrate, such as a cloth substrate. Furthermore, the image transfer sheet of the present invention transfers an image that does not substantially fade after repeated washings.

The base layer 12 of the image transfer sheet of the present invention is typically a base paper that has a basis weight of about 15 $g/m^2$ to 350 $g/m^2$. For some embodiments, the paper basis weight is from about 15 $g/m^2$ to 250 $g/m^2$. While base weights for paper are described herein, it is understood that, depending upon a particular embodiment, substantially any paper base weight is usable. The base paper is, for some embodiments, coated with clay or a hold-out coating. A saturated base paper is also usable. The clay coating or hold-out coating is applicable to one side for some embodiments or to both sides for other embodiments.

The release layer 14 is typically silicone coated on one side of the release layer or on both sides. Other suitable release coatings usable in the image transfer sheet of the present invention include solid waxes, polyethylene wax, an amide wax, Teflon® powder, a fluorine type release coating, a fluorocarbon release coating, phosphoric acid ester type surfactants and silicone oils.

The release coating is prepared, for some embodiments, by dissolving or dispersing in a solvent. The release coating layer may also be prepared by addition to water or solids or by reaction of amino-modified silicone oil or epoxy-modified silicone oil. The release coating is applied to the base paper by any coating method, such as air knife, roll coater, rod and so forth or by extruding or corn extruding with other release layers or by a hot release polymer having an organopolysiloxane component or a lay chain alkyl component in the side chain of the polymer or by using a standard silicone coating water-based solvent. The release coating may also be applied without solvent.

The release coating thickness is between 0.001 and 10 microns. For some embodiments, the release coating thickness is 0.05 to 3 microns. The average release is up to about 2,000 units, as measured by Tessak 12 inches/minute at a specific angle.

For some embodiments, the polymer layer 18 is a polyethylene. The polymer layer is an ink receiving layer. The polymer layer is also an image imparting layer. For some embodiments, the polymer layer has adhesive properties. The polyethylene is extrudable or co-extrudable with another resin with a melt index of about 20 to 3,000, and most preferred, ethylene acrylic acid, EAA, with a melt index from about 2 dg/minute to 3,000 dg/minute as measured by ASTM D-1238–79. For some embodiments, the melt index is about 10 to 1,500. The vicat softening point is less than 150 degrees Centigrade. The copolymer may be extruded or coextruded or may exist in solution as a product known as "NUCREL."

The polymer resin, when co-extruded with the release layer, may, for some embodiments be ethylene vinyl acetate, EVA, VA in a percent of 10 to 50%, copolymers which are blended or unblended with a resin tackifier. The polymer resin is blendable with other additives such as a slip agent, an optical brightener, a security feature additive, "GLOW-IN THE DARK" pigments, or color-changeable chemicals with temperature or PHOTOPIA®, with a melt index from 2 dg/minute to 3,000 dg/minute and a vinyl acetate percentage of 0–50%. For some embodiments, the melt index ranges from 8 to 2,500.

The VA % or Surlyn® % ranges from 5–50%. Surlyn® is a ionomer with a melt flow index of about 3 to 100. Surlyn® is manufactured by DuPont de Neimours of Wilmington, Del. One melt index embodiment ranges from about 5 to 20. Other polymers suitable for use in a polymer layer include a polyester adhesive resin having a melting point ranging from 20° C. to 300° C. and an elongation percent of from 20% to 3,000% at 25° C. Other ethylene acid copolymer resins such as ethylene/methacrylic acid (E/MAA) and ethylene/acrylic acid (E/AA) with an acid content ranging from 2% to 35% and a melt flow index ranging from 2–2,000 dg/minute are also suitable for use. In one embodiment, the melt index ranges from about 10–700. Other suitable polymers include nylon resin such as polyamide supplied by Societe Nationale Aquitaine (Elf) of Courbevoire, FR, DuPont de Neimours, GMS and Torrey, with or without plasticizer.

The nylon resins are usable with or without plasticizer. Plasticizer is, for some embodiments, added up to a concentration of 50% by weight. Particular embodiments optionally use a plasticizer up to about 30% by weight. The plasticizer is, for some embodiments, blended with a polymer called ENGAGE®, manufactured by Dow Chemical of Midland, Mich., and DuPont de Neimours. The ENGAGE® resin is, in some embodiments, blended in a ratio ranging from 95/5 nylon/ENGAGE® to 50/50 nylon/ENGAGE®. The polyamide is, in some embodiments, blended or coextruded with resins such as EVA or EAA or polyester resin, with or without plasticizers. Plasticizers are added to improve flexibility at concentrations as low as 2% or as high as 27%. One embodiment range is 5% to 20%. The melting temperature is, for some embodiments, less than 150 degrees Centigrade.

For other embodiments, the polymer layer comprises ethylene methylacrylate (EMA) copolymer in a concentration of 0 to 50% methyl acrylic acid and a concentration of 0–35% for some particular embodiments. The EMA includes, in some embodiments, an ester content of 0–50% for some embodiments with an ester concentration of 0 to 40% for particular embodiments.

The polymer layer also includes, for some embodiments, ethylene acrylic ester copolymers or ethylene acrylic ester terpolymers. For other embodiments, the polymer layer includes co-monomers and EMA, ethylene acrylic ester copolymers or ethylene acrylic ester terpolymers in concentrations up to about 50%. The melt index of these embodiments in g/10 microns, ranges from 1 to 500, vicat point under 130 degrees Centigrade, and preferably under 90 degrees Centigrade.

Other polymer embodiments include ethylene/acrylic ester/maleic anhydride terpolymers having a vicat temperature that is less than 150 degrees Centigrade and comonomers in a concentration of 0 to 50%, preferably 0 to 35%. Other polymers include escor acid terpolymers with vicat softening points of less than 150 degrees Centigrade, preferably less than 100 degrees Centigrade. Another polymer includes ethylene n-butyl acrylate with an ester concentration of up to 40%. These polymers are extruded or coextruded as one or multiple layers alone or blended with low density polyethylene, ethylene and vinyl acetate.

Other polymer embodiments include copolymers of ethylene and vinyl acetate that contain up to 50% vinyl acetate by weight with or without additives such as paraffin wax, optical brightener, $T_iO_2$ or $T_iO_2$ xtenders, up to 50% by weight, slip agents, antistatic agents, and so forth, or antioxidants. These co-polymers have a Melt Index of 1 to 3000 dg/10 min., as measured in ASTM D1238–79. The copolymers have a Softening point ring and ball of 9 degrees Centigrade, as measured in ASTM E 28–67 (77) from 10 degrees Centigrade to 250 degrees Centigrade.

Figure 2:
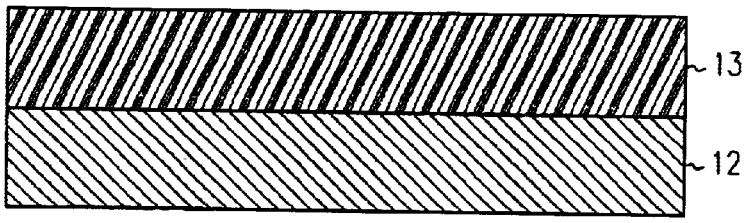
FIG. 2 illustrates a cross-sectional view of a base layer-resin layer combination of one embodiment of the image transfer sheet of the present invention.

One embodiment of the base layer with a release layer overlay 14 is shown in FIG. 2. The base layer for this embodiment 12 is paper or film. This embodiment does not include a release layer or a separate adhesive layer. Instead, the resin layer, which comprises EAA or EVA or a blend of EAA or EVA has adhesive and release properties. Some embodiments have use as a low tack repositionable adhesive.

To make the image transfer sheet, the release layer and polymer layer may be separately extruded onto the base paper layer or may be co-extruded. The polymer layer is extruded to a thickness of 0.2 mils which is 5 g/m$^2$ to 7 mils which is 200 g/m$^2$ of one polymer or a blended mix of polymer resin combinations described herein, with or without separate layers of a PSA resin. The polymer is, for some embodiments, coated to a thickness of 0.1 mils or about 2.5 g/m$^2$ to 200 g/m$^2$. The polymer is co-extruded against the release layer 12.

The polymer layer 18 is coated with an ink-receiving layer 20. The ink-receiving layer is, for some embodiments, printed with indicia using ink from an ink-jet printer. For other embodiments, indicia are applied with a laser printer or by thermal transfer application. For other embodiments, the polymer layer 18 is not coated with an ink receiving layer. A second ink-receiving layer is optionally coated over the first receiving layer, depending upon the type of final image desired.

Figure 3:
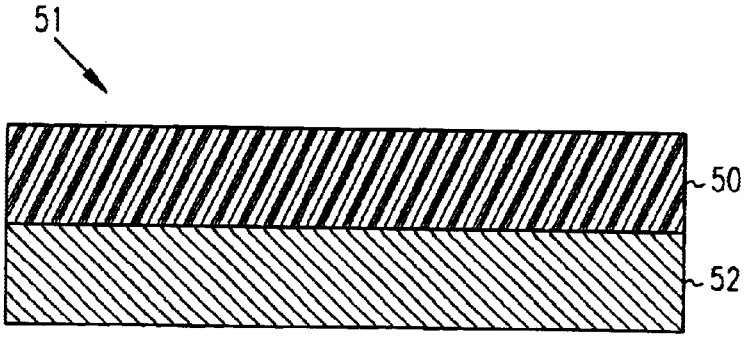
FIG. 3 illustrates another embodiment of a base layer—adhesive layer laminate combination of the image transfer sheet of the present invention.

The image transfer sheet is applied to a substrate by separating the polymer and ink-receiving layers and adhesive layer from the base paper and release layer. The adhesive layer contacts the substrate and adheres the polymer and ink-receiving layers to the substrate. In one embodiment, the adhesive layer is a PSA adhesive and has a tackiness that ranges from low to extreme. In an embodiment shown at 50 in FIG. 3, an adhesive layer 50 is co-extruded with a base layer to form a laminate. For low tack embodiments, the layers are removable from articles. Other images may be printed onto the ink receiving layer or layers.

To transfer an image from the image transfer sheet of the present invention 10 to a substrate, the base layer 12 is peeled away from the rest of the sheet. For embodiments such as is shown in FIG. 1, the base layer is peeled away at the release layer 14. For embodiments such as is shown in FIG. 2, the base layer 12 is peeled at the resin or polymer layer 13.

Separation of the base layer 12 exposes the adhesive layer 16. Once separated and exposed, the adhesive layer 16 is positioned to contact the substrate. Pressure is applied as needed to adhere the image to the substrate. The image has, as discussed, been pre-printed onto the polymer layer 20 and, for some embodiments, has been pre-printed onto a second ink receiving layer. For embodiments with no adhesive, transfer occurs by use of an iron that applies heat to the substrate receiving the image and the image. A heat press is also usable.

Another embodiment of the image transfer sheet of the present invention includes a base layer and a transfer layer that comprises polyamide. Image transfer with this sheet embodiment occurs with low or no addition of heat. The base layer comprises paper or film having a weight of 20 g/m$^2$ to 400 g/m$^2$. The base layer is fabricated, for some embodiments, with a release coating and for other embodiments, without a release coating.

The polymer transfer layer 18 includes extruded polyamides or a co-extrusion of polyamide—polyamide, polyamidehot melt polyester resin, polyamide—polyurethane resin, polyamide—adhesive, polyamide—epoxy, especially epoxy with a melting point of 40 degrees C. to 300 degrees C. and a glass transition of −200 degrees C. to a glass transition top of +200 degrees C. and an elongation percent of 20% up to about 4000% at 25 degrees C. The polyamide is obtainable from Torray, EF ATO CHEM, EMS and DuPont de Neimours.

Specific materials that could be used include, but are not limited to, H. B. Fuller NP 4038, Bostik Adhesive Polyester 4101, or other grade, or Ricon 131 MA 10, or Poly bd R—45HT Resin and Poly bd 605 resin, other polyamide resin, nylon with or without plasticizer, epoxy or polyurethane. Other resin that is blendable includes ENGAGE®, BYNEL®, modified ethylene acrylic acid terpolymer, EVA, EAA, M/EAA, manufactured by DuPont, polyethylene, epoxy, and polyurethane. Other resins include EMAC, ABAC, which is a Union Carbide EAA ionomer. One other material is a polyamide particle in an EAA solution.

One other material is a urea formaldehyde particle. The urea formaldehyde particle has a high surface area and a size ranging from about 0.1 to 6 microns. The particle has reactive metholyl groups up to about 2% by weight of the particle. One urea formaldehyde particle is manufactured by Markirswerk Co. Of Germany under the name, "Bergopak M2" or "Bergopak M3". Another particle is an aluminum oxidelsilica particle. This particle has a surface area of 300 square meters or more. This particle is manufactured by Aluisse of Switzerland, under the name GL1 or GL3, or Martoxilg 13.

Some embodiments include a plasticizer, such as BBSA, in a concentration of up to 50% by weight, 30% for some embodiments. Other polymers are also usable. A binder such as acrylic, polyethylene wax, polyurethane, EVA, PV OH, PVP, polyamides sol, epoxy, polyester resin, alkyd, solvent or water base or 100% solids is added for some applications.

Other additives such as cationic surfactants or dye fixing agents in concentrations up to 70% by weight are added.

The optional ink receptive layer and the polymer transfer layer optionally include pigments such as silica, polyamide particles, titanium oxide, calcium carbonate, zinc sulfate and other pigments in a concentration of up to 100% by weight.

Presented herein are examples of specific embodiments of the image transfer sheet of the present invention. These examples are presented to illustrate particular layers and particular specifications for the layers and are not intended to limit the scope of the present invention.

EXAMPLE 1

Figure 4:
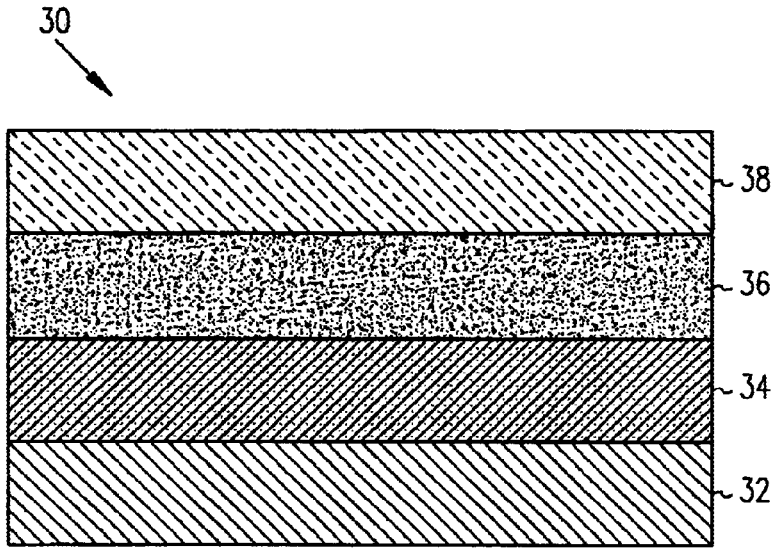
FIG. 4 illustrates another embodiment of the image transfer sheet of the present invention.

One image transfer sheet, illustrated generally at 30 in FIG. 4, included a base paper layer 32 with a release layer 34 that overlayed the base paper layer. A PSA adhesive layer 36 overlayed the release layer and an EAA polymer layer 38 overlayed the PSA adhesive layer. The base paper was a 15 g/m$^2$ silicone-coated grade from Eastern Fine which was a co-extruded EAA resin with a melt index of about 550 dg/minute. The release layer was co-extruded with pelletized PSA resin HC2278 which was obtained from Fuller with a 2 mil thickness. The EAA polymer was top coated with ink-jet, thermal transfer coating layers. The EAA polymer was printed and was separated from the base layer, and was applied with pressure against a T-shirt without heat. Thicknesses that have been found acceptable for the image transfer sheet include 0.2 mils, 0.5 mils, 0.6 mils, 1 mil, 1.5 mils, 2 mils, 2.5 mils and 3 mils.

EXAMPLE 2

The ink-receiving layer 38 of the example shown in FIG. 4 or one or both of ink-receiving layers 20 and 22 of the embodiment shown in FIG. 1 were blended with titanium oxide or other pigment in a concentration of up to 60% by weight. Other suitable materials include EAA or EVA with ethylene vinyl acetate. The material has a softness or glass transition temperature of −20 to +30 and an airflex of 111 to 400. The image transfer layer was fabricated as described herein. The image transfer sheet was applied to a dark substrate. In particular, the image transfer sheet was applied to a dark fabric.

EXAMPLE 3

The image transfer sheets shown in FIGS. 1 and 4 were prepared so that one or more of the image transfer sheet layers were blended with a Glow-in-the-Dark pigment. The Glow-in-the-Dark pigment was added in a concentration of up to 60% by weight of each of the layers. The image transfer sheet was then applied to a dark fabric substrate. The concentration of Glow-in-the-Dark determines the intensity and duration of the glow. For some embodiments, the glow has a duration of up to 50 hours.

EXAMPLE 4

In other embodiments of the image transfer sheet, a changeable color was added to one or more of the layers of the image transfer sheet. The color-changeable material transferred utilized a material such as a chromacolor, a neon light which glows in the dark for over 50 hours depending upon concentration and weight or thickness of neon, and was a phosphorescent pigment, a zinc-oxide pigment or a photochromic light-sensitive colorant. A concentrated batch of one or more of the materials of polyethylene, EVA, EAA, polystyrene, polyamide or MEAA which was a Nucrel® like material was prepared. The color-changeable material was added to the layer material up to a concentration of 100% by weight with 50% by weight being typical. For some embodiments, the color-changeable material was also added to the ink receiving layer. The color-changeable material technologies changed the image transfer sheet from colorless to one or more of yellow, orange, red, rose, red, violet, magenta, black, brown, mustard, taupe, green or blue. The color-changeable material changed the image transfer sheet color from yellow to green or from pink to purple. In particular, sunlight or UV light or a change in temperature induced the color change.

The color-changeable material was blendable in a batch process with materials such as EAA, EVA, polyamide and other types of resin. The polymer was extruded to 0.5 mils or 14 g/m$^2$ to 7 mils or 196 g/m$^2$ against a release side or a smooth side for a hot peel with up to 50% by weight of the color-changeable concentrate.

The first ink-receiving layer was an acrylic or SBR EVA, PVOH, polyurethane, MEAA, polyamide, PVP, or an emulsion of EAA, EVA or a blend of EAA or acrylic or polyurethane or polyamide, modified acrylic resins with non-acrylic monomers such as acrylonitrile, butadiene and/or styrene with or without pigments such as polyamide particle, silica, $COCl_3$, titanium oxide, clay and so forth. The ink-receiving layer is capable of receiving ink from printers, lasers, copiers and dye sublimation applications.

The thermoplastic copolymer was an ethylene acrylic acid or ethylene vinyl acetate grade, water-or solvent-based, which was produced by high pressure copolymerization of ethylene and acrylic acid or vinyl acetate.

Using the color-changing material, a binder was additionally added in a concentration of up to 90% with the concentration being up to 73% for some embodiments. The pigment concentration was, for some embodiments, about 50%. The PHOTOPIA® concentration was about 80% maximum. The additive was about 70% maximum. The additive included a pigment or binder. The coating thickness was about 0.1 mils or 2.5 g/m$^2$ and could have been up to 2 mils or 56 g/m$^2$ on a dry basis.

The second receiving layer included the PHOTOPIA® material in a concentration of up to 70% by weight with a range of 2 to 50% by weight for some embodiments. The pigment ranged from 0 to 90% and the binder from 0 to 80%. This type of coloring scheme was used in shirts with invisible patterns and slogans. The PHOTOPIA® products were obtained from Matsui International Company, Inc.

While they have been described as being incorporated in the ink-receiving layer, the PHOTOPIA® products were also applicable as a separate monolayer. PHOTOPIA®-containing layers were coated onto the release layer by conventional coating methods such as by rod, slot, reverse or reverse gravure, air knife, knife-over and so forth.

Chromacolor materials could also be added to the image transfer sheet. Chromacolor materials changed color in response to a temperature change. The chromocolor solid material had a first color at a first temperature and changed color as the temperature changed. For instance, solid colors on a T-shirt became colorless as a hot item or the outside temperature increased.

Chromacolor was prepared as a polypropylene concentrate, polyethylene, polystyrene, acrylo-styrene (AS) resins, PVC/plasticizer, nylon or 12 nylon resin, polyester resin, and EVA resin. The base material for this image transfer sheet embodiment was selected from materials such as paper, PVC, polyester, and polyester film.

This type of image transfer sheet was fabricated, in some embodiments, without inkjet receiving layers. It was usable by itself for color copy, laser printers, and so forth and then was transferable directly onto T-shirts or fabrics.

In one or both receiving layers, permanent color was addable with a color-changeable dispersion when the temperature changed, that is, when color disappeared. The color returned to permanent color as was shown in previous examples. With this formulation, the changeable color was added to one or more layers in a concentration of up to about 80% by weight with a range of 2–50% by weight being typical. The base paper for this embodiment was about 90 g/m$^2$. About 0.5 mils EAA were applied with 10% PHOTOPIA® or temperature-sensitive color-changeable materials. The top coat layer was an ink-receiving layer that contained polyamides, silica, $COCl_3$ for 15% color-changeable items.

This embodiment is usable in conjunction with conventional printing technology, laser imaging, color copies, and die sublimation applications.

EXAMPLE 5

An EVA DuPont 3180 or 3185 with or without a co-extruded layer of Surlyn® 1702, obtained from DuPont, was employed as the polymer layer. The remaining image transfer sheet was as described in FIGS. 1 and 4. PSA was usable for a cold transfer or for use with an iron or heat press transfer or other type of heat activation at 55 to 160 degrees.

EXAMPLE 6

Figure 5:
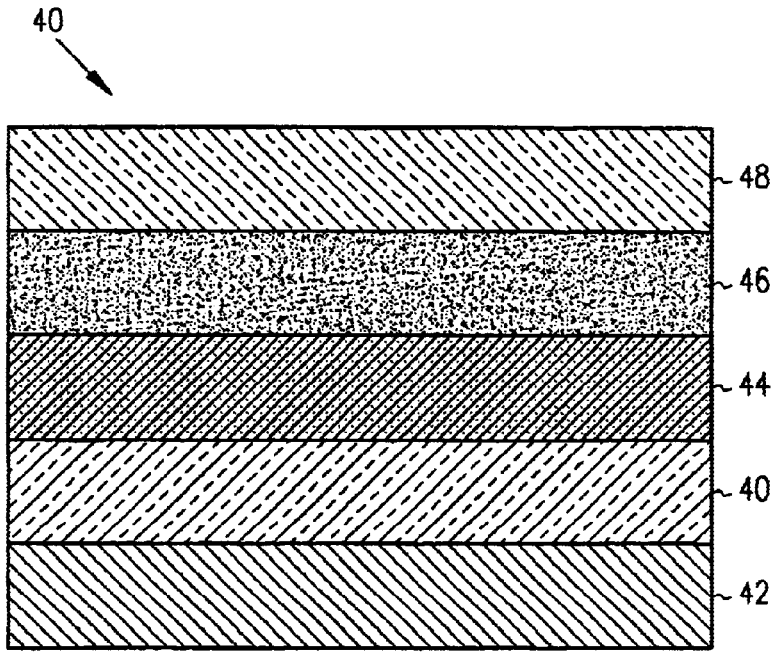
FIG. 5 illustrates one other embodiment of the image transfer sheet of the present invention in cross section.

Another embodiment of the image transfer sheet of the present invention was shown at 40 in FIG. 5. This image transfer sheet included a base layer 42 that included a paper. The paper had a base weight which was 90 g/m$^2$ silicone coated with 100 g of release layer material 44. An adhesive layer 46 was a co-extruded layer of 1.5 mils polyester, 0.75 mils polyamide, and 1.5 mils MB Fuller adhesive. An ink-jet receiving layer was applied with or without a color-changeable chemical or Glow-in-the-Dark chemical or dark fabric transfer.

EXAMPLE 7

Polyamides were extruded or co-extruded to a density of 5 g/m$^2$ or 0.2 mils to 200 g/m$^2$ or 7.00 mils. The polyamide was either pigmented or non-pigmented. Pigments were added in concentrations up to about 50% and included titanium oxide, calcium carbonate and so forth. Other additives included an optical brightener, a slip agent, a wax additive and an antioxidant, Glow in the Dark pigments, color changeable by heat or light or fluorescent colors. The polyamides with additives were added to 0.5 mils or 14 g/m$^2$ to 136 g/m$^2$or 6 mils.

EXAMPLE 8

A release base paper was silicone coated to 90 g/m$^2$. Polyamide was overlayed onto the base layer by extrusion or co-extrusion to a thickness of 1.5 mils. Polyamide was M548, manufactured by ELF. The polyamide layer was coated with an inkjet premium receiving layer which was transferred at 160 degrees F., 175 degrees F., 200 degrees F., 250 degrees F., 300 degrees F., 400 degrees F., 450 degrees F. The image transfer sheet displayed excellent transfer with substantially no yellowness. Transferred images had an excellent washability at 40 degrees C.

EXAMPLE 9

The procedure described in Example 7 was employed with a Bostik Polyester 4101. Image transfer was performed at about 200 degrees F. or higher. The transferred image displayed no yellowness, an excellent transfer, and no cracking.

EXAMPLE 10

Polyamide and/or polyester and/or EVA were extruded or coextruded with an adhesive layer against release paper to make an image transfer layer. An inkjet receiving coating layer was then applied. The ink receiving layer was printed with an HP 890 printer. Pressure was applied to permit image transfer. The transferred image displayed an excellent adhesion to fabric and an excellent washability.

EXAMPLE 11

An image transfer sheet was made in a manner described in Example 10. Additionally, pigment was added to the image transfer layer and optionally the ink receiving layer. The pigment was a "Glow in the Dark" pigment with a concentration of up to 60% by weight. Other pigments optionally added included color changeable materials, light changeable materials, and dark transfer materials.

EXAMPLE 12

A release base paper of 90 g/m$^2$ was provided. The release paper was co-extruded to 1.75 mils with polyamide and to 0.75 mils with polyester Bostik 4101. The coextruded product was top coated with one or more inkjet receiving layers.

EXAMPLE 13

An image transfer sheet was prepared as described for Example 12 except that 1.5 mils of polyester resin were co-extruded with 0.75 mils of polyamide. The product had an excellent laser, color copy and transfer.

EXAMPLE 14

The image transfer sheet of Example 12 was prepared with a use of plasticizer polyamides and about 15% plasticizer.

EXAMPLE 15

The image transfer sheet of Example 12 was prepared with a use of 1.2 mils EAA co-extruded with 0.75 mils of polyamnide.

EXAMPLE 16

The image transfer sheet of Example 12 was prepared with a use of 1.5 mils EVA. DuPont 3180 and 0.75 mils polyamides.

EXAMPLE 17

The image transfer sheet of Example 12 was prepared with a use of 2 mils polyamide ELF and 1 mil of EAA, 20% acrylic acid.

EXAMPLE 18

The image transfer sheet of Example 12 was prepared with a use of 1.5 mils EVA, a modifier with wax and DuPont 3200–2 and 1.0 mils EAA.

EXAMPLE 19

The image transfer sheet of Example 12 was prepared with a use of a second polyester layer that had a melt point of 127 degrees C.; a melt point viscosity of 192,000 at 180 degrees C. and an elongation of 490% at 25 degrees C. The first EAA layer was 1.25 mils. The second polyester layer was 0.75 mils.

EXAMPLE 20

A 50/50 EAA/PE polymer with a melt point of 120 degrees C. was extruded against a release and base layer to 2 mils. The polymer was coated with an ink jet receiving layer or layers to make an image transfer sheet. The image transferred displayed excellent washability and softness.

All examples were tested for laser transfer without ink jet receiving layers and displayed good to excellent color retention.

EXAMPLE 21

One or more layers of EMA are extruded or co-extruded to a thickness of about 12 microns to about 220 microns. The extruded layer or layers may be EMA alone. For some embodiments, the extruded layer or layers may be EMA with a concentration of up to about 50% by weight, titanium oxide extenders. For other embodiments, the extruded layer or layers comprise EMA with a Glow in the Dark pigment.

EXAMPLE 22

One or more of the following materials are blended to make a polymer layer EMA and EAA; EMA and EVA; EMA and EVA and EAA; EMA and polyester resin; EMA and nylon; EMA and low density polyethylene for one layer. This layer is overlayed with polymer layers that comprise titanium oxide or titanium oxide extenders in concentrations up to 30%.

EXAMPLE 23

The following materials are mixed and coextruded to form the following layers:

An EMA layer having a thickness of 25 microns and 0.5 mils of Surlyn;

An EMA layer having a thickness of 50 microns and 0.75 mils of Surlyn; and

An EMA layer having a thickness of 100 microns and 0.5 mils of Surlyn.

This coextrusion is repeated with EAA and EVA. For some embodiments, EVA is used alone, in place of the EMA. For other embodiments, EAA is used alone, in place of EMA to make layers having thicknesses described for EMA. It has surprisingly been found that EMA provides a softer handling product while still providing excellent washability.

EXAMPLE 24

The following materials are mixed and coextruded to form the following layers:

An EMA blend with polyamide; a mixture of EMA and EVA; EMA and EVA coextruded at rates of 1–20 and 20–1. These layers are adhered with a PSA adhesive. These layers overlay an ink jet receiving layer. The ink jet receiving layer comprises a polyacetate polymer in an EA solution with or without vinyl acetate polymer. This material has a soft feel.

For some embodiments transferring an image to a dark substrate, the ink receiving layer includes ash titanium in a concentration of 30%. For other embodiments titanium oxide is blended in a ratio of 3:2 titanium oxide to polymer such as M 2 Bergopak. For some embodiments titanium oxide is added to top layers and Glow-In-The-Dark pigment is added to lower layers in a concentration of about 3%. For other embodiments, a white layer is prepared by blending EA with Airflux 110.

EA is solved and mixed wit Ergosol, latex, Airflux and cationic resin to form a mixture. The mixture is applied to the surface of release paper without extrusion. For some embodiments, the mixture is applied to the ink jet receiving layer.

Although the present invention has been described with reference to particular embodiments, workers skilled in the art will recognize that changes may be made in form and detail without departing from the spirit and scope of the invention.

What is claimed is:

1. An image sheet, comprising: a base layer, a release layer that overlays the base layer; an adhesive layer consisting of one or more of PSA adhesive, water-activated adhesive, UV cured adhesive, electro-beam cured adhesive or other pressure sensitive adhesive that overlays the release layer; an image imparting polymer layer comprising an ethylene copolymer that overlays the adhesive layer; and a primer layer for receiving ink and an image created by ink wherein the adhesive layer is effective for transferring the image to a fibrous substrate without application of heat.

2. The image transfer sheet of claim 1 wherein the ethylene copolymer is ethylene methacrylate.

3. The image transfer sheet of claim 1 wherein the ethylene copolymer is ethylene acrylic ester copolymer.

4. The image transfer sheet of claim 1 wherein the image imparting layer has adhesive properties.

5. The image transfer sheet of claim 4 wherein the image imparting layer has release properties.

6. The image transfer sheet of claim 1 and further comprising a base layer that supports the adhesive layer and the image imparting layer.

7. The image transfer sheet of claim 1 wherein the base layer and the adhesive layers laminated.

8. The image transfer sheet of claim 1 wherein the image imparting layer further comprises coloring agents.

9. The image transfer sheet of claim 8 wherein the coloring agents change color with changes in temperature with changes in pH.

* * * * *

UNITED STATES PATENT AND TRADEMARK OFFICE

PATENT NO. : 6,753,050 B1
DATED : June 22, 2004
INVENTOR(S) : Dalvey et al.

It is certified that error appears in the above-identified patent and that said Letters Patent is hereby corrected as shown below:

Title page,
Item [74], *Attorney, Agent, or Firm,* delete "Schwegmen" and insert -- Schwegman --, therefor, delete "Woesner" and insert -- Woessner --, therefor.

Column 12,
Line 38, delete "layer," and insert -- layer; --, therefor.
Line 59, delete "layers" and insert -- layer are --, therefor.
Line 64, after "temperature" insert -- or --.

Signed and Sealed this

First Day of February, 2005

JON W. DUDAS
*Director of the United States Patent and Trademark Office*